United States Patent [19]

O'Day, Jr. et al.

[11] 3,932,344

[45] Jan. 13, 1976

[54] COMPOSITE WIRE CONTAINING A MIXTURE OF PHENOLIC AND THERMOPLASTIC RESINS AS A BINDER

[75] Inventors: William R. O'Day, Jr., Concord; Norman D. Bensky, Lexington; James D. Le Blanc, Winthrop, all of Mass.

[73] Assignee: Kennecott Copper Corporation, New York, N.Y.

[22] Filed: Feb. 22, 1974

[21] Appl. No.: 444,702

[52] U.S. Cl. ..... 260/38; 117/105.2; 161/174; 260/37 M; 260/841; 260/842; 260/844; 260/848

[51] Int. Cl.[2] ..... C08L 61/10

[58] Field of Search ..... 260/37 M, 38, 841, 842, 260/844, 848; 117/105.2; 161/174

[56] References Cited

UNITED STATES PATENTS

| | | | |
|---|---|---|---|
| 2,997,413 | 8/1961 | Wagner | 117/105.2 X |
| 3,342,626 | 9/1967 | Batchelor et al. | 117/105.2 |
| 3,438,931 | 4/1969 | Mitchell et al. | 260/38 |
| 3,455,868 | 7/1969 | D'Alessondro | 260/38 |
| 3,491,055 | 1/1970 | Talley | 260/38 X |
| 3,503,844 | 3/1970 | Clement | 117/105.2 X |
| 3,598,693 | 8/1971 | Andersen et al. | 260/38 X |
| 3,723,165 | 3/1973 | Longo et al. | 117/105.2 X |

*Primary Examiner*—Donald E. Czaja
*Assistant Examiner*—S. M. Person

[57] ABSTRACT

A composite wire of a metal, a metal oxide or carbide of a metal, metal oxide or metal carbide powder and a mixture of a phenolic resin and a thermoplastic resin cured in a suitable shape for use in metallizing or coating a surface by flame spraying.

9 Claims, No Drawings

COMPOSITE WIRE CONTAINING A MIXTURE OF PHENOLIC AND THERMOPLASTIC RESINS AS A BINDER

This invention relates to a sprayable composition for use in a flame spraying device; more particularly, this invention relates to flame spraying of a non-drawable metal and alloys thereof, metal carbide, or metal oxide compositions whereby these are formed in a composition capable of control not only in respect to its working in the flame zone, but also in respect to a metal or metal oxide deposit being formed and its characteristics e.g. surface coating. Articles of manufacture made from these compositions are within the scope of the invention.

PRIOR ART

It is known that it would be desirable to form a composite wire useful in the flame spraying of a non-drawable metal. For example, U.S. Pat. No. 2,570,649 discloses a heat-fusible, non-pliable metal in substantially subdivided form mixed and formed in spray-wire shape by synthetic plastic and a binder substance. U.S. Pat. No. 2,997,413 teaches the desirability of forming a metal oxide flame spray stick wherein the stick is shaped by sintering particles of a refractory metal oxide. U.S. Pat. No. 3,305,326 discloses a powder mixture for flame spray comprising a boron containing nickel or cobalt metal powder and coated powder particles comprising a metal nucleus and a coating of a metal capable of exothermically reacting with the metal nucleus to form an intermetallic compound. In U.S. Pat. No. 2,943,951 a flame spraying method and composition is disclosed. The composition comprises molybdenum disilicide coated with a film of silicon dioxide. The granular particles are mixed with a binder and extruded into a string approximately ⅛ inch in thickness. Still further, a flame spray material as a composite in a form suitable for flame spraying formed of at least two metal components which exothermically react with each other when melted is disclosed in U.S. Pat. No. 3,322,515.

SUMMARY OF THE INVENTION

This invention comprises a composite wire consisting essentially of a metal powder or metal oxide powder and a mixture of thermoplastic resins and a specific phenolic resin. It has been discovered that composite wires made from certain metal powders or metal oxide powders and thermoplastic binders result in poor flame spraying performance. However, it has now been found that binders of thermoplastic materials lose their strength in the 200° to 400° Fahrenheit range thus releasing the metal powder before it had been melted or these binders fail cohesively. As a result, a deposit is formed of fine, cold particles which adhere poorly to the substrate and to themselves and consequently have poor mechanical strength. Moreover, the use of phenolic resins with the metal powders overcome the above noted deficiency by holding the powders in the oxyacetylene flame until the metal powders are melted and, as melted, spray in relatively large droplets thus approaching the same flame spraying characteristics of solid metal wires; however, the composite wire of phenolic resin and metal powder alone produce a wire that is brittle and cannot be successfully wound on a reel and subsequently unwound for feeding through the flame spraying equipment and the cohesive properties of the wire, its working, and the performance of the coating cannot be readily controlled.

It has now been discovered that by a specific combination of phenolic resins, thermoplastic resins, and a metal powder or a metal oxide powder or a metal carbide powder, a composite wire can be made for flame spraying said metals, metal oxides and carbides having very high melting points whereby adherent coatings on a variety of substrates are obtained having good properties. The novel composite wire is a tough, flexible wire capable of being reeled and unreeled and performs in flame spraying as well as a conventional solid wire, thus providing a readily utilizable source of hard-to-draw metals, oxides or ceramics for use such as coatings.

DETAILED DESCRIPTION OF THE INVENTION

In an embodiment of this invention, the composite wire will contain from about 75 to about 95 percent of a refractory metal powder. The remainder of the composite wire, i.e., from about 5 to 25 percent weight, will be a mixture of thermoplastic and phenolic resins, with the phenolic resin to thermoplastic material being in the ratio from 4:1 to 1:9 based on these two components in the composite; preferably based on the total composite phenolics constitute 7 to 12 percent by weight.

Because the metal powder, metal oxide powder, or metal carbide powder or mixtures of these, are melted prior to spraying in the flame spraying gun, the powder particle size may vary, except that particles which are too coarse, produce an extruded wire with a rough exterior surface. It has been found by experience that particles with a size smaller than those which will pass through an 80-mesh screen (U.S. Standard Sieve Series) are satisfactory. It is optional that all or most particles be within a specific size range. It is preferred to use particles finer than 100-mesh and coarser than 5 microns.

Preferably the metal base materials, which are incorporated into the composite wire, are high melting powder materials or those difficult to shape into a wire by conventional wire-making methods, such as molybdenum, boron, tantalum, tungsten, iron, silicon, alloys of each, cobalt, alloys of nickel and chromium with iron, Hastelloy (a trademark for a series of high strength nickel based corrosion resistant alloys) and carbides of the above mentioned metals, and metals such as vanadium and titanium or oxides such as alumina, zirconia, titania, and chromia.

It has been found that up to as much as 25 percent by weight or more of the resin mixture may be incorporated into the wire composition. For economical and contamination considerations, it is preferred to compound a wire having as small an amount of the resin mixture as possible. It has also been found that to produce a composite wire having typical characteristics lending itself to extruding, coiling and uncoiling for use in flame spraying techniques it requires, as a practical lower limit, a thermoplastic material as a component thereof approximately 2.5 percent by weight, but more desirably 3 percent by weight of the total composite. A thermoplastic material component up to about 20 percent by weight may be used as an upper limit.

The term thermoplastic as used herein applied particularly to synthetic resins that are softened by heat and then regain their original properties upon cooling.

Thermoplastic resins that have been found to work as a combination with the metel, metal carbide, or metal oxide, and the phenolic resin are polyethylene, polypropylene, polystyrene, polyethylene-vinyl acetate, polyamide such as Nylon 6/6, etc. and a series of polyester resins marketed under the trademark "VITEL".

In attempting to produce a composite wire capable of withstanding the mechanical handling in flame spraying, a number of thermosetting resins including polyesters, epoxies, polyurethanes, and silicones have been inventigated. These thermosetting resins did prove unsatisfactory for unknown reasons. The phenolic resins proved to be the only thermosetting resin useful in making a satisfactory composite wire. The term "thermosetting" is used herein as applied to a phenoplast resin; more specifically, a phenol and an aldehyde, more particularly and preferably phenol and formaldehyde resin, which solidifies or sets on heating and cannot be remelted.

The phenolic resins are obtained by the condensation of phenol or a substituted phenol with an aldehyde such as formaldehyde (including paraformaldehyde), acetaldehyde, and furfural. As a phenol, phenol itself, metacresol or 3,5-xylenol is used. Phenol-formaldehyde resins are typical and constitute the main class of phenoplast resins. Phenol-furfural resins exhibit a somewhat sharper transition from the soft thermoplastic stage to the cured, infusible state and can be fabricated into a composite wire since these resins have a general tendency to harden before the actual curing conditions are reached. The quantity of the thermosetting phenolic resins in the composite wire can range from a high of 22 percent down to as low as about 2½ percent by weight based on the total weight of the composite wire.

In general, the phenolic resins are readily available materials of commerce and can be purchased as such from many sources. In accordance with the invention, these resins are used for purposes of formulation in their uncross-linked state (in respect to basic curing, Stage A resins, as distinguished from Stage B or C, the last of which is a fully cross-linked, i.e., thermoset resin; or in respect to acid catalyst curing, in the "novolak" stage). In A or novolak stage, these resins are soluble in solvents such as alcohols, ketones, etc. When sold, these A stage or novolak resins are capable of being cross-linked, in the case of the A stage resins by further heating and in the case of the novolak resins by mixing with a catalyst such as hexamethylenetetramine.

In a preferred method for preparing a composite wire of each of a thermoplastic material, i.e. polyester resin, polyethlene, polypropylene, or an ethylene-vinyl acetate polymer is added in solid form to a solvent such as methylethyl ketone. A viscous liquid is obtained. The phenolic material is then thoroughly admixed with the metal powder, metal carbide or metal oxide powder or mixtures of these. As phenolic resin, a phenol-formaldehyde condensate of 1 mole phenol and up to 1.5 moles of formaldehyde, by weight is used. The thermoplastic material is then added to the phenolic resin/metal powder mixture. After thoroughly stirring, the mixture is dried at 200° Fahrenheit for about one hour. The hard material is pulverized to produce a powder suitable for feeding to a plastics extruder, relying upon the thermosetting and thermoplastic materials for fusion and binding. The temperature range during extrusion is from 200°–300° Fahrenheit. The extruded wire is coiled directly onto reels for shipment. Of the above metals, molybdenum powder is preferred.

Inasmuch as the curing rate of the phenolic resin can be regulated with additives such as catalysts etc., the extrusion barrel and die temperature, as well as the pressure, it may be regulated to obtain the necessary cure stage. Generally, a die temperature of 200° Fahrenheit to 220° Fahrenheit (maybe up to 250° is used. Pressure in the die is about 3,000 psig. to 6,000 psig. The admixture may also be extruded twice.

A strong tough wire of the standardized flame spray gun sizes were made and when post cured from 30 to 80 minutes at a temperature from 150°–180° Centigrade the wire was even stronger, tougher, and more flexible than when first extruded.

Typical spraying of a wire of 90 percent molybdenum powder, 5 percent phenolic, and 5 percent of Elvax, i.e., ethylene-vinyl acetate copolymer (The DuPont Corporation - 400 Series as described in its Technical Information Bulletin) as follows:

| | | |
|---|---|---|
| Surface | : | mild steel |
| Spray distance | : | 4 inches |
| Oxygen | : | 30 psig. |
| Acetylene | : | 17 psig. |
| Air | : | 100 psig. |
| Wire feed | : | 10.6 inches per minute |

The molten molybdenum did not bounce off the coated surface as much as when using other solid wires made for flame spraying. The physical appearance of the surface was good--molten molybdenum with very few large lumps. The hardness was 1945 diamond pyramid hardness, indicating a high interstitial oxygen content and some carbide formation. The test procedure is described in ASTM (E92) 31. A conventional molybdenum spray showed a hardness of 627 dph. A blend test showed that the novel molybdenum spray adhered to the plate well.

In use for flame spraying, the wire may be fed at speeds of from about 7 to 30 inches per minute with the spray gun held at a distance between about 2 to 7 inches from the surface to be coated. Oxygen, acetylene and air pressures to the gun are adjusted according to practices known to those familiar with the art of flame spraying. Surface hardness will vary depending upon the material to be coated and the material being coated.

EXAMPLE I (COMPARISON EXAMPLE)

Molybdenum powder and a phenolic resin in novolak stage of condensation were mixed in a weight ratio of 4 to 1. Wire was extruded from this mixture and cured at 350° Fahrenheit for 10 minutes to harden the phenolic to its thermosetting stage. The result was a stiff, brittle rod, rather than a coilable wire.

EXAMPLE II (COMPARISION EXAMPLE)

Molybdenum was blended with heated (softened) ELVAX (Trademark of E. I. DuPont de Nemours for its brand of ethylenevinyl acetate copolymer) in a weight ratio of 92 to 8. A flexible wire was produced from this composition and this wire flame sprayed according to industry practice. The coating produced by the wire was soft, had poor adhesion to the substrate and had poor integrity as measured by wear tests. Microscopic examination revealed that the powder and the coating had been deposited cold. The tip of the wire after spraying was not molten, but looked like the molybdenum-plastic mixture that had not been in the hot zone of the torch.

EXAMPLE III (COMPARISON EXAMPLE)

Molybdenum (90%) was combined with a thermosetting-thermoplastic resin mixture 5 percent and 5 percent respectively based on the total weight of composite. The thermoset plastic was an epoxy resin (of a bisphenol and glycidol condensate cured with an amine) and the thermoplastic resin was ELVAX (E. I. DuPont de Nemours ethylene-vinyl acetate copolymer). The formed wire produced poor flame-spraying results because periodic release of large pieces of the wire occured during spraying, part of the plastic binder was not consumed in the flame, and deposited on the substrate along with the molybdenum.

EXAMPLE IV

Molybdenum powder, phenolic powder, and VITEL (trademark of Goodyear Tire and Rubber Co.) polyester of a diacid and a glycol were dissolved in methyl ethyl ketone and were blended in a ratio of 89:7:4 by weight. The mix was dried in an oven at 200° Fahrenheit for an hour to drive off the solvent. The dried material was broken up into small pieces approximately 1/32 inch in diameter. These were fed to a plastics extruder with a barrel temperature of 250° Fahrenheit and extruded. The wire produced was coiled, and was thereafter ready for use in an oxyacetylene flame spraying gun.

EXAMPLE V

Molybdenum powder, and a phenolic resin (novolak type) of phenol and formaldehyde dissolved in methyl alcohol, and ELVAX (a trademark of E. I. DuPont de Nemours, Inc. ethylene-vinyl acetate copolymer) were dissolved in hot toluene, mixed in a ratio of 90:5:5, and dried in an oven at 200 degrees Fahrenheit for one hour (hexa had been admixed to the phenolic resin beforehand). The dried material was crushed and extruded as in the example above whereby curing is obtained and, if needed, further carried out by heating anywhere from 30 to 80 minutes at a temperature from 150°–170° Centigrade. When flame sprayed, the pointed tip of the wire was a cone of melted molybdenum, indicating that melting took place before the molybdenum was released from the wire.

EXAMPLE VI

Molybdenum, phenolic resin (as described in Example V) dissolved in methy alcohol, and VITEL (trademark of Goodyear Tire and Rubber Co. polyester) dissolved in methyl ethyl ketone were mixed in a ratio of 70:20:10 and dried to remove the solvents. After grinding, the material was extruded as in Example IV. Flame spraying again resulted in molten droplets of molybdenum deposited on the substrate and the wire again exhibited a melted tip.

EXAMPLE VII

A mixture of 90 percent tungsten metal powder, 5 percent phenolic resin and 5 percent thermoplastic were prepared as in Example V and extruded into a strong, flexible wire. The resulting wire was sprayed onto a substrate whereby a smooth, dense coating was obtained and the wire melted before deposition. The wire speed was decreased to 10 inches per minute for complete melting of the tungsten metal.

EXAMPLE VIII

In a similar manner as in Example VII, a 90 percent alumina, 5 percent phenolic and 5 percent thermoplastic (ELVAX) wire composite were prepared and resulted, when sprayed at a rate of 20 inches per minute in a hard, dense coating.

In a similar manner as illustrated in Example V, the previously mentioned metals, alloys, carbides, and oxides are prepared and are flame sprayable.

Further, mixtures of a metal powder, which is low melting e.g. copper and carbide, which is very high melting, may be combined. Thus, for example, copper and silicon carbide powder has been combined in a composite wire formed by the methods illustrated above (as in Example V) and a coating obtained which had good abrasive resistance and heat dissipation and was found to be useful, such as on brake and clutch surfaces.

What is claimed as new and desired to be secured by Letters Patent is:

1. As an article of manufacture, a composite wire adapted for flame spraying consisting essentially of a particulate material selected from the group consisting of molybdenum, boron, tantalum, tungsten, tungsten carbide, silicon carbide, alumina, zirconia, oxides of chrome, titania, alloys of nickel and chromium with iron, and mixtures of these, said material having a particle size smaller than 80-mesh in an admixture with a mixture of a thermoplastic resin and a phenolic resin in a cured state wherein said material comprises from about 75 percent to about 97½ percent by weight of total composite with the balance being said phenolic resin and thermoplastic resin in a ratio to each other of 4:1 to 1:9.

2. The article as defined in claim 1, and wherein the particle size of said material is from 1 to 200 microns.

3. The article as defined in claim 1 wherein the thermoplastic resin is selected from the group consisting of polyvinyl resins, polystyrene resins, polyethylene resins, polypropylene resins, polyester resins and mixtures thereof.

4. The article as defined in claim 1 wherein from about 2½ percent to about 20 percent by weight of said wire is a resin mixture of a phenolic resin and a thermoplastic resin.

5. The article as defined in claim 1 and wherein the phenolic resin in a phenol-formaldehyde resin and the thermoplastic is an ethylene-vinyl acetate resin.

6. The article as defined in claim 1 consisting essentially of powdered molybdenum and a 1 to 1 weight ratio mixture of a phenolic resin and a thermoplastic resin.

7. The article as defined in claim 4 wherein the thermoplastic resin is selected from the group consisting of polyvinyl resins, polystyrene resins, polyethylene resins, polypropylene resins, acrylic resins, ethylene-vinyl acetate polyamide resins, polyester resins, and mixtures thereof.

8. The article as defined in claim 4 wherein the mixture of resins comprise from about 5 to 25 percent by weight of the composite wire.

9. The article as defined in claim 5, wherein the thermoplastic resin is a polyester resin.

* * * * *